US011668532B2

(12) United States Patent
Christensen Phillips et al.

(10) Patent No.: US 11,668,532 B2
(45) Date of Patent: Jun. 6, 2023

(54) TUBE SHEETS FOR EVAPORATOR COIL

(71) Applicant: Carrier Corporation, Palm Beach Gardens, FL (US)

(72) Inventors: Charlie Christensen Phillips, Indianapolis, IN (US); Joshua Jenkins, Clayton, IN (US); Kevin Mercer, Danville, IN (US); James Amick, Danville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 352 days.

(21) Appl. No.: 17/020,112

(22) Filed: Sep. 14, 2020

(65) Prior Publication Data

US 2021/0080193 A1 Mar. 18, 2021

Related U.S. Application Data

(60) Provisional application No. 62/902,119, filed on Sep. 18, 2019.

(51) Int. Cl.
*F28F 1/02* (2006.01)
*F25B 39/02* (2006.01)

(52) U.S. Cl.
CPC ..... *F28F 1/022* (2013.01); *F25B 39/02* (2013.01)

(58) Field of Classification Search
CPC .... F28F 1/022; F28F 1/00; F28F 1/003; F28F 17/005; F25B 39/02; F28D 1/00; F28D 7/00; F28D 7/10; F22B 1/066; F24F 13/22
USPC ..... 165/172, 70, 173, 175, 177
See application file for complete search history.

(56) References Cited

U.S. PATENT DOCUMENTS

| | | | | |
|---|---|---|---|---|
| 2,886,956 | A | 5/1959 | Loveley | |
| 5,341,870 | A * | 8/1994 | Hughes | F28F 3/025 165/110 |
| 5,613,554 | A | 3/1997 | Bull et al. | |
| 6,196,303 | B1 | 3/2001 | Hepper | |
| 6,513,579 | B1 | 2/2003 | Kent et al. | |
| 6,557,356 | B2 | 5/2003 | Underwood | |
| 6,874,230 | B2 | 4/2005 | Chikuma et al. | |
| 7,418,827 | B2 | 9/2008 | Rios | |
| 7,430,877 | B2 * | 10/2008 | Davenport | F24F 13/224 62/272 |
| 7,635,019 | B2 | 12/2009 | Higashiyama | |

(Continued)

FOREIGN PATENT DOCUMENTS

| | | | |
|---|---|---|---|
| CN | 106524472 | A | 3/2017 |
| CN | 106678962 | A | 5/2017 |

(Continued)

OTHER PUBLICATIONS

David Anthony, et al.; "Air Flow Distribution Through an A-Shaped Evaporator Under Dry and Wet Coil Conditions"; The National Institute for Standards and Technology, International Refrigeration and Air Conditioning Conference 2010; pp. 1.

*Primary Examiner* — Justin M Jonaitis
(74) *Attorney, Agent, or Firm* — Cantor Colburn LLP

(57) ABSTRACT

A heat exchanger is provided and includes coils, a header disposed at an end of the coils to distribute fluid into the coils, an evaporator tube fluidly communicative with an end of the header and a tube sheet disposed against a side of one of the coils which is nearest to the end of the header to catch condensate dripping off the evaporator tube and to drain the condensate away from the coils.

20 Claims, 4 Drawing Sheets

(56) References Cited

U.S. PATENT DOCUMENTS

| | | | | |
|---|---|---|---|---|
| 7,669,641 | B2 | 3/2010 | Rembold et al. | |
| 7,793,514 | B2 | 9/2010 | Rios et al. | |
| 8,683,817 | B2 | 4/2014 | Fraser | |
| 8,769,979 | B2 * | 7/2014 | Timbs | F24F 13/222 62/291 |
| 9,328,939 | B2 | 5/2016 | Edens et al. | |
| 9,759,446 | B2 | 9/2017 | Stewart et al. | |
| 9,777,962 | B2 | 10/2017 | Mastroianni et al. | |
| 10,077,917 | B2 * | 9/2018 | Amick | F24F 1/0071 |
| 10,240,853 | B2 | 3/2019 | Mercer et al. | |
| 11,105,565 | B2 * | 8/2021 | Chehade | F28D 1/0443 |
| 11,255,594 | B2 * | 2/2022 | Carlton | F28F 17/005 |
| 2007/0169497 | A1 * | 7/2007 | Rios | F28F 17/005 62/286 |
| 2007/0169498 | A1 * | 7/2007 | Rios | F24F 13/222 62/286 |
| 2007/0169500 | A1 * | 7/2007 | Rios | F28F 9/001 62/286 |
| 2010/0041327 | A1 | 2/2010 | Desler | |
| 2013/0168067 | A1 * | 7/2013 | Edens | F24F 1/032 165/163 |
| 2017/0370658 | A1 | 12/2017 | Kirklin et al. | |
| 2019/0212061 | A1 | 7/2019 | Jin et al. | |

FOREIGN PATENT DOCUMENTS

| | | | |
|---|---|---|---|
| CN | 108954535 | A | 12/2018 |
| EP | 1128150 | B1 | 8/2001 |
| EP | 1754946 | A2 | 2/2007 |
| EP | 2672191 | A1 | 5/2012 |
| EP | 2587173 | B1 | 5/2015 |
| KR | 20010001916 | A | 1/2001 |
| KR | 200398415 | Y1 | 10/2005 |

* cited by examiner

TUBE SHEETS FOR EVAPORATOR COIL

CROSS REFERENCE TO RELATED APPLICATION

This application claims the benefit of Provisional Patent Application No. 62/902,119, filed Sep. 18, 2019, which is incorporated herein by reference in its entirety.

BACKGROUND

The following description relates to heat exchangers and, more specifically, to a tube sheet for an evaporator coil of a heat exchanger in an air conditioning application.

Air conditioning (often referred to as AC or A/C) is the process of removing heat and moisture from the interior of an occupied space. Air conditioning is typically used to improve the comfort of occupants and to cool and dehumidify rooms filled with heat-producing electronic devices, such as computer servers, power amplifiers and to display and store products, such as perishable food, drugs and artwork. Air conditioners often use a fan to distribute conditioned air to an occupied space and cooling is typically achieved through a refrigeration cycle, but sometimes evaporation or free cooling is used.

In many cases, cooling of air in an air conditioner requires that the air passes through a heat exchanger. Water in the air is thus condensed on an evaporator coil and some of the tubing containing refrigerant. This condensate needs to be drained, but providing for drainage can be complicated. For example, in some air conditioners, water that condenses on the evaporator coil typically falls into a drain pan but water that condenses on the tubing containing the refrigerant may not have a clear drain path.

BRIEF DESCRIPTION

According to an aspect of the disclosure, a heat exchanger is provided and includes coils, a header disposed at an end of the coils to distribute fluid into the coils, an evaporator tube fluidly communicative with an end of the header and a tube sheet disposed against a side of one of the coils which is nearest to the end of the header to catch condensate dripping off the evaporator tube and to drain the condensate away from the coils.

In accordance with additional or alternative embodiments, the coils are disposable in an air stream and the fluid includes refrigerant.

In accordance with additional or alternative embodiments, the coils are provided in a sloped configuration, the heat exchanger further includes a drain pan disposed at an end of the coils opposite the header, the tube sheet extends along the side of the one of the coils from the header to the drain pan and the evaporator tube is fluidly communicative with an input end of the header to deliver the fluid to the header.

In accordance with additional or alternative embodiments, the coils are provided in a V-shaped configuration with the header provided as a first header at an end of a first portion of the coils and a second header at an end of a second portion of the coils, the heat exchanger further includes a drain pan disposed at respective ends of the first and second portions of the coils opposite the first and second headers, respectively, the tube sheet is provided as a first tube sheet that extends along the side of the one of the coils of the first portion of the coils from the first header to the drain pan and as a second tube sheet that extends along the side of the one of the coils of the second portion of the coils from the second header to the drain pan and the evaporator tube is fluidly communicative with an input end of the first header to deliver the fluid to the first header and with an output end of the second header to receive the fluid from the second header.

In accordance with additional or alternative embodiments, a drain pan is disposed at an end of the coils opposite the header and a T-shaped bar.

In accordance with additional or alternative embodiments, the tube sheet has one of a C-shaped cross-section, an L-shaped cross-section and a curved cross-section.

In accordance with additional or alternative embodiments, the tube sheet is attached to the side of the one of the coils by one or more of a weld, one or more fasteners and adhesive.

In accordance with additional or alternative embodiments, foam is interposed between the tube sheet and the side of the one of the coils.

According to an aspect of the disclosure, a method of assembling a heat exchanger including coils, a header to distribute fluid into the coils, an evaporator tube fluidly communicative with an end of the header and a tube sheet is provided. The method includes disposing the tube sheet against a side of one of the coils which is nearest to the end of the header and configuring the tube sheet to catch condensate dripping off the evaporator tube and to drain the condensate away from the coils.

In accordance with additional or alternative embodiments, the configuring of the tube sheet includes forming the tube sheet with one of a C-shaped cross-section, an L-shaped cross-section and a curved cross-section.

In accordance with additional or alternative embodiments, the disposing includes attaching the tube sheet to the side of the one of the coils by one or more of a weld, one or more fasteners and adhesive.

In accordance with additional or alternative embodiments, the method further includes interposing foam between the tube sheet and the side of the one of the coils.

According to an aspect of the disclosure, a heat exchanger assembly is provided and includes a door and a heat exchanger accessible via the door. The heat exchanger includes coils, a header disposed at an end of the coils to distribute fluid into the coils, an evaporator tube fluidly communicative with an end of the header and a tube sheet disposed to be urged by the door against a side of one of the coils which is nearest to the end of the header to catch condensate dripping off the evaporator tube and to drain the condensate away from the coils.

In accordance with additional or alternative embodiments, the coils are disposable in an air stream and the fluid includes refrigerant.

In accordance with additional or alternative embodiments, the coils are provided in a sloped configuration, the heat exchanger further includes a drain pan disposed at an end of the coils opposite the header, the tube sheet extends along the side of the one of the coils from the header to the drain pan and the evaporator tube is fluidly communicative with an input end of the header to deliver the fluid to the header.

In accordance with additional or alternative embodiments, the coils are provided in a V-shaped configuration with the header provided as a first header at an end of a first portion of the coils and a second header at an end of a second portion of the coils, the heat exchanger further includes a drain pan disposed at respective ends of the first and second portions of the coils opposite the first and second headers, respectively, the tube sheet is provided as a first tube sheet that extends along the side of the one of the coils of the first portion of the coils from the first header to the drain pan and as a second tube sheet that extends along the side of the one of the coils of the second portion of the coils from the second header to the drain pan and the evaporator tube is fluidly communicative with an input end of the first header to deliver the fluid to the first header and with an output end of the second header to receive the fluid from the second header.

In accordance with additional or alternative embodiments, a drain pan is disposed at an end of the coils opposite the header.

In accordance with additional or alternative embodiments, the tube sheet has one of a C-shaped cross-section, an L-shaped cross-section and a curved cross-section.

In accordance with additional or alternative embodiments, the tube sheet is attached to the side of the one of the coils by one or more of a weld, one or more fasteners and adhesive.

In accordance with additional or alternative embodiments, foam is interposed between the tube sheet and the side of the one of the coils.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, a tube sheet is provided for use in a heat exchanger of an air conditioner as a bracket that extends off a side of the heat exchanger (i.e., off the side of the heat exchanger coils). The bracket or tube sheet can be C, L or S shaped and runs a length of the coils. For a V-shaped coil assembly, two tube sheets are used and for a sloped coil assembly only one is necessary.

It is to be understood that, because of the presence of headers in a heat exchanger, it can be unusual for the coils to extend to the walls of the cabinet in both the front and the back. The tube sheet extends from the front of the coils to a door of the unit, sealing the upper section of the cabinet from the lower section. Here, the tube sheet is placed under the vapor (cold) tube and any water that condenses on the vapor tube drips onto the tube sheet which directs the water into the drain pan. The tube sheet can be attached to the header at the top and/or to the drain pan at the bottom and can be sealed to the coils via weld, a fastener, adhesive or foam.

Figure 1:
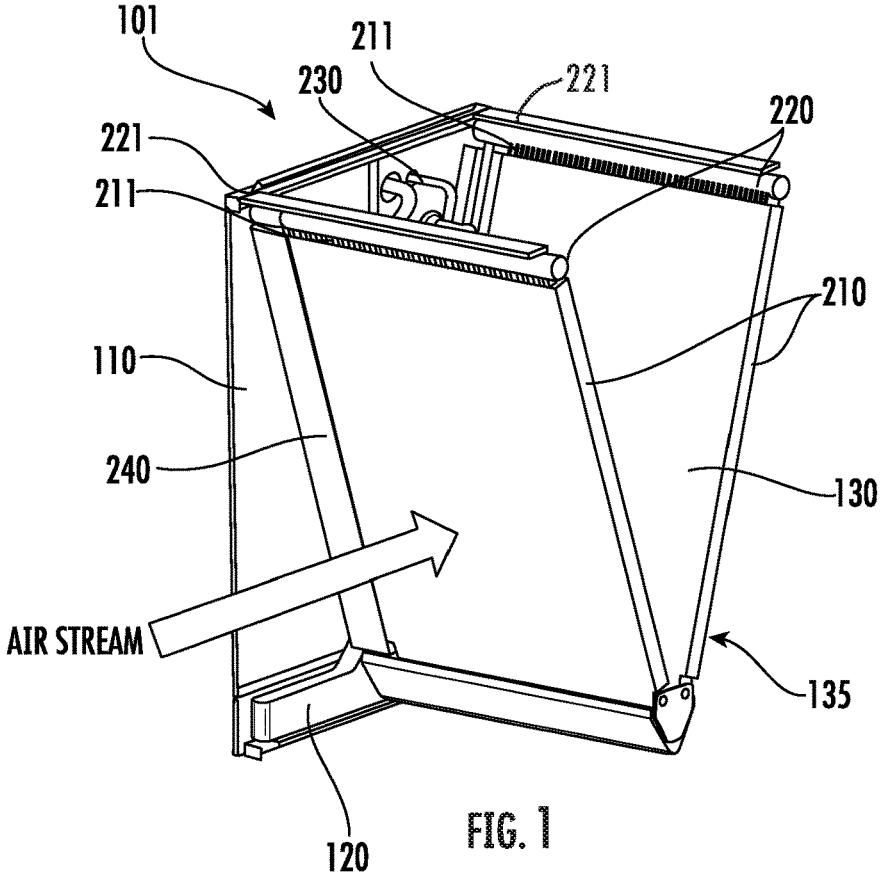
FIG. 1 is a perspective view of a heat exchanger assembly in accordance with embodiments.
Figure 2:
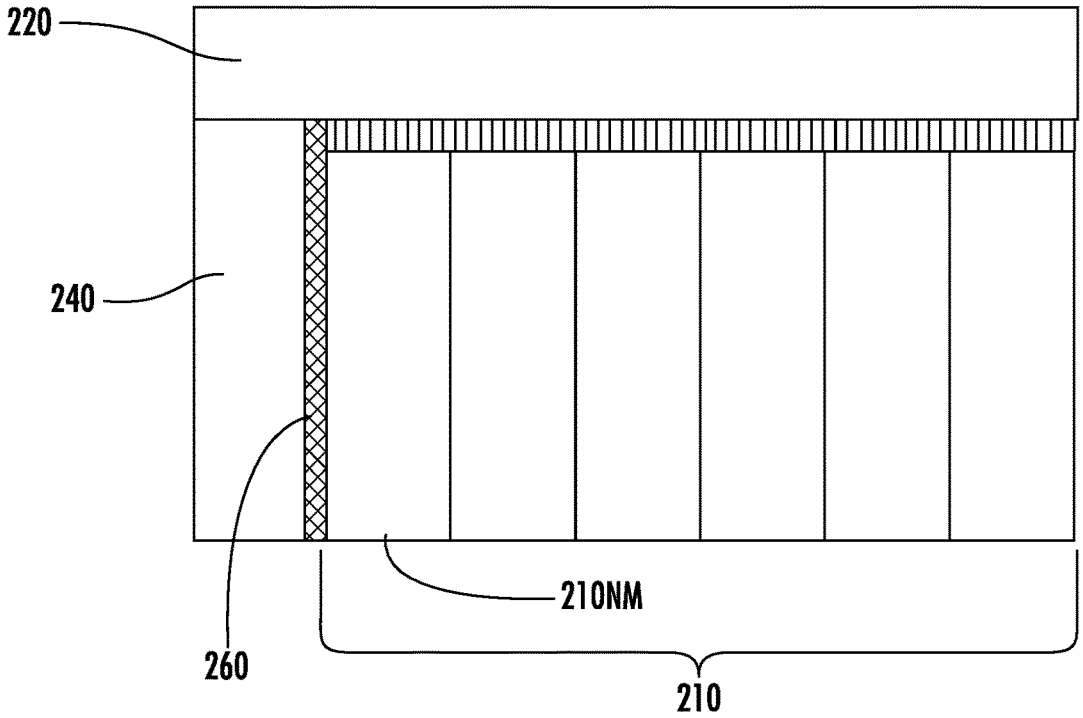
FIG. 2 is a side schematic view of components of the heat exchanger assembly of FIG. 1 in accordance with embodiments.

With reference to FIGS. 1 and 2, a heat exchanger assembly 101 is provided and includes a door 110, a T-shaped bar 120 and a heat exchanger 130. The heat exchanger 130 is accessible via the door 110.

Figure 3:
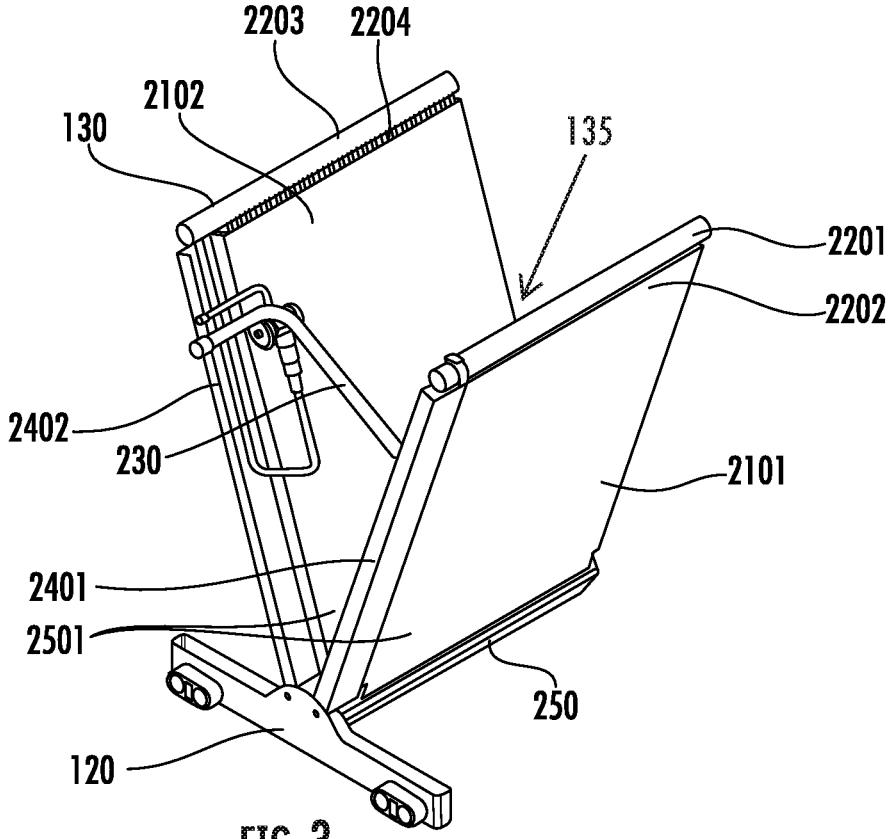
FIG. 3 is a perspective view of the heat exchanger assembly of FIG. 1 in accordance with embodiments.
Figure 4:
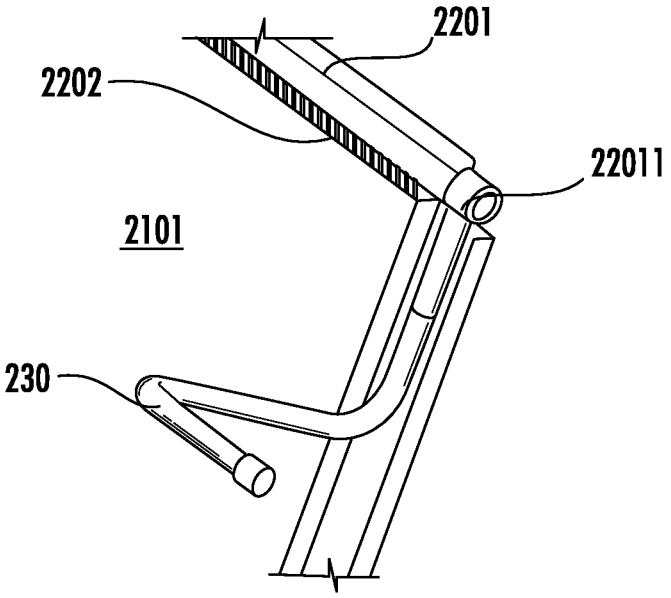
FIG. 4 is an enlarged perspective view of a portion of the heat exchanger assembly of FIG. 1 in accordance with embodiments.
Figure 5:
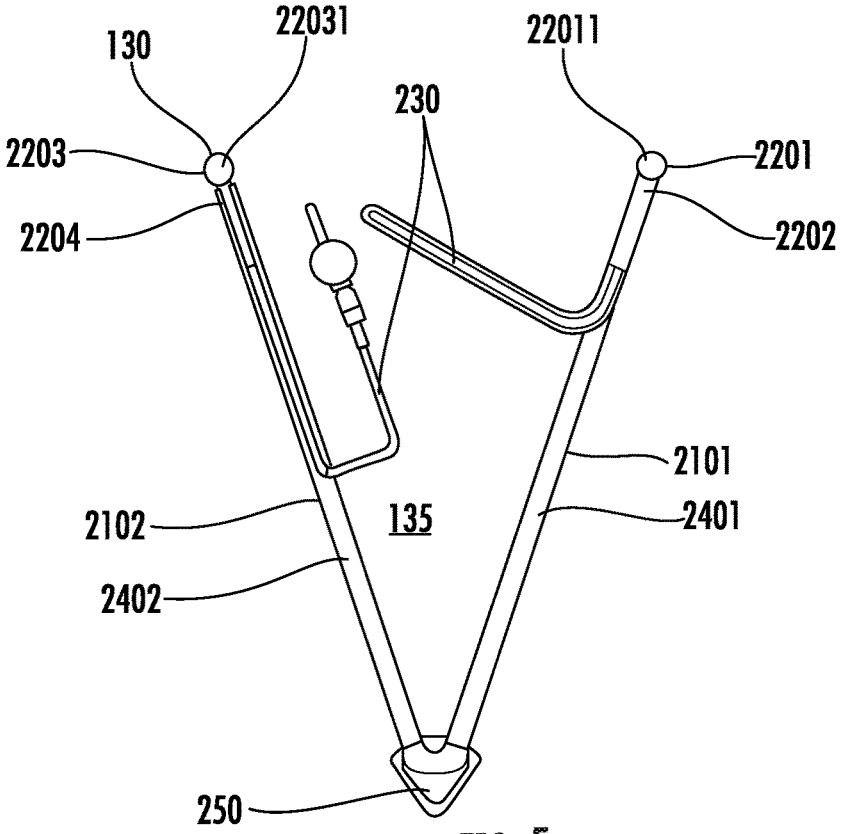
FIG. 5 is an elevational view of the heat exchanger assembly of FIG. 1 in accordance with embodiments.

With continued reference to FIGS. 1 and 2, and with additional reference to FIGS. 3-5, the heat exchanger 130 includes coils 210, a header 220 that is disposed at an end 211 of the coils 210 to distribute fluid into the coils 210, an evaporator tube 230 that is fluidly communicative with an end 221 of the header 220 and a tube sheet 240. The tube sheet 240 is disposed against a side of one of the coils 210 which is nearest to the end 221 of the header 220 (i.e., nearest coil $\mathbf{210}_{NM}$ of FIG. 2). The tube sheet 240 is configured to catch condensate dripping off the evaporator tube 230 and to drain the condensate away from the coils 210. In some cases, the tube sheet 240 can be urged against the side of the nearest coil $\mathbf{210}_{NM}$ by the door 110 or by another external feature.

In accordance with embodiments, the coils 210 can be disposable in an air stream through the heat exchanger assembly 101 (see FIG. 1) and the fluid can include refrigerant.

As shown in FIGS. 1, 3 and 5, the coils 210 can be provided in a V-shaped configuration 135 with the header 220 provided as a first header 2201 at an end (i.e., a top end) 2202 of a first portion 2101 of the coils 210 and a second header 2203 at an end (i.e., a top end) 2204 of a second portion 2102 of the coils 210. In these or other cases, the heat exchanger 130 can further include a drain pan 250 of which the T-shaped bar 120 is a component. The drain pan 250 is disposed at respective ends (i.e., respective bottom ends) 2501 of the first and second portions 2101 and 2102 of the coils 210 opposite the first and second headers 2201 and 2203, respectively. Also, in these or other cases, the tube sheet 240 is provided as a first tube sheet 2401 and a second tube sheet 2402. The first tube sheet 2401 extends along the side of the nearest coil $\mathbf{210}_{NM}$ (see FIG. 2) of the first portion 2101 of the coils 210 from the first header 2201 to the drain pan 250. The second tube sheet 2402 extends along the side of the nearest coil $\mathbf{210}_{NM}$ (see FIG. 2) of the second portion 2102 of the coils 210 from the second header 2203 to the drain pan 250.

As shown in FIGS. 3-5, the evaporator tube 230 can be fluidly communicative with an input end 22011 of the first header 2201 to deliver the fluid to the first header 2201 and with an output end 22031 of the second header 2203 to receive the fluid from the second header 2203.

Although the coils 210 have been described herein and illustrated in FIGS. 1, 3 and 5 as being provided in a V-shaped configuration 135, it is to be understood that this is not required and that other embodiments exist. For example, the coils 210 can be provided in a slanted configuration, which would be essentially a half of the V-shaped configuration 135. This slanted configuration can be obtained by a person of ordinary skill in the art from the descriptions provided herein and from the illustrations of FIGS. 1, 3 and 5 without any substantial input or assistance and further description thereof is not necessary.

Figure 6:
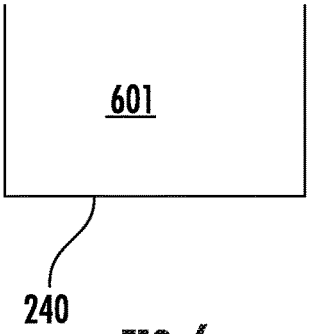
FIG. 6 is a schematic illustration of a tube sheet of the heat exchanger of FIGS. 1-5 with a C-shaped cross-sectional shape in accordance with embodiments.
Figure 7:
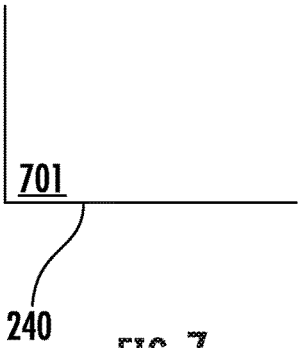
FIG. 7 is a schematic illustration of a tube sheet of the heat exchanger assembly of FIGS. 1-5 with an L-shaped cross-sectional shape in accordance with embodiments.
Figure 8:
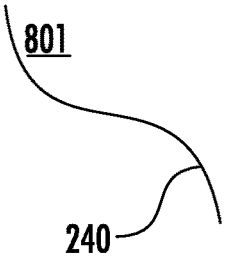
FIG. 8 is a schematic illustration of a tube sheet of the heat exchanger assembly of FIGS. 1-5 with a curved cross-sectional shape in accordance with embodiments.

With reference to FIGS. 6-8, the tube sheet 240 can be formed from sheet metal or another similar material and can be configured with one of a C-shaped cross-section 601 (see FIG. 6), an L-shaped cross-section 701 (see FIG. 7) and a curved cross-section 801 (see FIG. 8).

Figure 9:
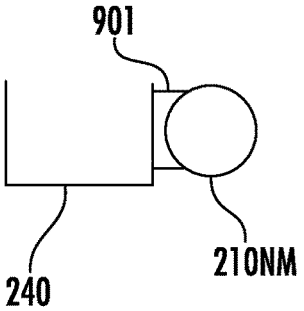
FIG. 9 is a schematic illustration of a weld between a tube sheet of the heat exchanger assembly of FIGS. 1-5 and a nearest coil in accordance with embodiments.
Figure 10:
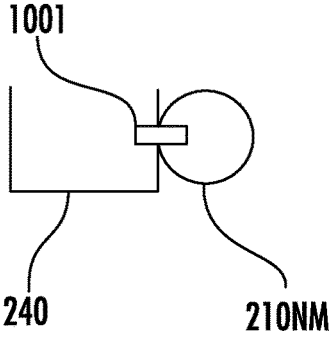
FIG. 10 is a schematic illustration of a fastener for a tube sheet of the heat exchanger assembly of FIGS. 1-5 and a nearest coil in accordance with embodiments.
Figure 11:
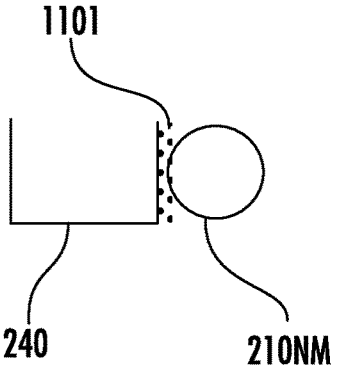
FIG. 11 is a schematic illustration of adhesive between a tube sheet of the heat exchanger assembly of FIGS. 1-5 and a nearest coil in accordance with embodiments.

With reference to FIGS. 9-11, the tube sheet 240 can be attached to the side of the nearest coil $\mathbf{210}_{NM}$ by one or more of a weld 901 (see FIG. 9), one or more fasteners 1001 (see FIG. 10) and adhesive 1101 (see FIG. 11). In each case, the tube sheet 240 can be sealed to the side of the nearest coil $\mathbf{210}_{NM}$ such that fluid leakage between the tube sheet 240 and the side of the nearest coil $\mathbf{210}_{NM}$ is eliminated or substantially limited.

With reference back to FIG. 2, the heat exchanger 130 can further include foam 260. Such foam 260 can be interposed between the tube sheet 240 and the side of the nearest coil $\mathbf{210}_{NM}$. The foam 260 can serve as a sealant between the tube sheet 240 and the side of the nearest coil $\mathbf{210}_{NM}$ such that fluid leakage between the tube sheet 240 and the side of the nearest coil $\mathbf{210}_{NM}$ is eliminated or substantially limited. In addition, the foam 260 can be compliant and, in some cases, elastomeric. Thus, where the tube sheet 240 is urged against the side of the nearest coil $\mathbf{210}_{NM}$ by the door 110 or by another external feature, the foam 260 can absorb pressure applied to the tube sheet 240 by the door of the external feature to limit deformation of the tube sheet 240 that would otherwise be cause by the pressure.

Figure 12:
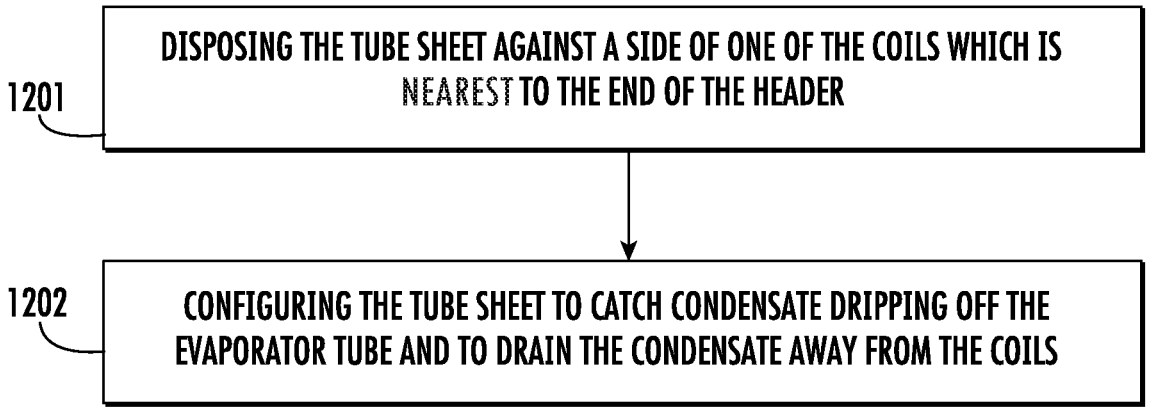
FIG. 12 is a flow diagram illustrating a method of assembling a heat exchanger in accordance with embodiments.

With reference to FIG. 12, a method of assembling a heat exchanger that includes coils, a header to distribute fluid into the coils, an evaporator tube fluidly communicative with an end of the header and a tube sheet as described herein is provided. As shown in FIG. 12, the method includes disposing the tube sheet against a side of one of the coils which is nearest to the end of the header (1201) and configuring the tube sheet to catch condensate dripping off the evaporator tube and to drain the condensate away from the coils (1202). In accordance with embodiments, the configuring of the tube sheet of operation 1202 can include forming the tube sheet with one of a C-shaped cross-section, an L-shaped cross-section and a curved cross-section and the disposing of operation 1201 can include attaching the tube sheet to the side of the one of the coils by one or more of a weld, one or more fasteners and adhesive with or without foam being interposed between the tube sheet and the side of the one of the coils.

Technical effects and benefits of the present disclosure are the provision of a tube sheet for use with a heat exchanger of an air conditioner. The tube sheet creates an air dam that helps to separate upper and lower sections of a cabinet and forces the air to travel through the heat exchanger coils. The tube sheet eliminates the need for a delta plate and allows access to both sides of the heat exchanger coils when a door is removed to thus make cleaning and servicing easier. The tube sheet also catches condensate dripping off evaporator tubing external to the heat exchanger coils and transports this condensate to the drain pan. The tube sheet also provides structural support when attached to a header or the drain pan.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A heat exchanger, comprising:

coils provided in a sloped configuration with each coil comprising:

a top end at a top of the sloped configuration; and a bottom end at a bottom of the sloped configuration;

a header disposed at the top ends of the coils to distribute fluid into the coils at the top of the sloped configuration;

an evaporator tube fluidly communicative with an end of the header; and a tube sheet disposed against a side of one of the coils which extends longitudinally along the sloped configuration at a location which is nearest to the end of the header to catch condensate dripping off the evaporator tube and to drain the condensate away from the coils.

2. The heat exchanger according to claim 1, wherein the coils are disposable in an air stream and the fluid comprises refrigerant.

3. The heat exchanger according to claim 1, wherein:

the heat exchanger further comprises a drain pan disposed at the bottom ends of the coils opposite the header at the bottom of the sloped configuration, the tube sheet extends along the side of the one of the coils extending longitudinally along the sloped configuration from the header to the drain pan, and the evaporator tube is fluidly communicative with an input end of the header to deliver the fluid to the header.

4. The heat exchanger according to claim 1, wherein:

the sloped configuration includes first and second sloped configurations forming a V-shaped configuration, the coils are provided in the V-shaped configuration with the header provided as a first header at the top ends of a first portion of the coils at the top of the first sloped configuration and a second header at the top ends of a second portion of the coils at the top of the second sloped configuration, the heat exchanger further comprises a drain pan disposed at respective bottom ends of the first and second portions of the coils opposite the first and second headers, respectively, at the respective bottoms of the first and second sloped configurations, the tube sheet is provided as a first tube sheet that extends along the side of the one of the coils of the first portion of the coils extending longitudinally along the first sloped configuration from the first header to the drain pan and as a second tube sheet that extends along the side of the one of the coils of the second portion of the coils extending longitudinally along the second sloped configuration from the second header to the drain pan, and the evaporator tube is fluidly communicative with an input end of the first header to deliver the fluid to the first header and with an output end of the second header to receive the fluid from the second header.

5. The heat exchanger according to claim 1, further comprising a drain pan disposed at the bottom ends of the coils opposite the header at the bottom of the sloped configuration and a T-shaped bar.

6. The heat exchanger according to claim 1, wherein the tube sheet has one of a C-shaped cross-section, an L-shaped cross-section and a curved cross-section.

7. The heat exchanger according to claim 1, wherein the tube sheet is attached to the side of the one of the coils extending longitudinally along the sloped configuration by one or more of a weld, one or more fasteners and adhesive.

8. The heat exchanger according to claim 1, further comprising foam interposed between the tube sheet and the side of the one of the coils extending longitudinally along the sloped configuration, the foam extending from the header at the top ends of the coils and toward the bottom of the sloped configuration.

9. A method of assembling a heat exchanger comprising coils provided in a sloped configuration with each coil comprising top and bottom ends at top and bottom ends of the sloped configuration, respectively, a header disposed at the top ends of the coils to distribute fluid into the coils at the top of the sloped configuration, an evaporator tube fluidly communicative with an end of the header and a tube sheet, the method comprising:

disposing the tube sheet against a side of one of the coils which extends longitudinally along the sloped configuration at a location which is nearest to the end of the header; and configuring the tube sheet to catch condensate dripping off the evaporator tube and to drain the condensate away from the coils.

10. The method according to claim 9, wherein the configuring of the tube sheet comprises forming the tube sheet with one of a C-shaped cross-section, an L-shaped cross-section and a curved cross-section.

11. The method according to claim 9, wherein the disposing comprises attaching the tube sheet to the side of the one of the coils extending longitudinally along the sloped configuration by one or more of a weld, one or more fasteners and adhesive.

12. The method according to claim 9, further comprising interposing foam between the tube sheet and the side of the one of the coils extending longitudinally along the sloped configuration, the foam extending from the header at the top ends of the coils and toward the bottom of the sloped configuration.

13. A heat exchanger assembly, comprising:

a door; and a heat exchanger accessible via the door, the heat exchanger comprising:

coils provided in a sloped configuration with each coil comprising:

a top end at a top of the sloped configuration; and a bottom end at a bottom of the sloped configuration;

a header disposed at the top ends of the coils to distribute fluid into the coils at the top of the sloped configuration;

an evaporator tube fluidly communicative with an end of the header; and a tube sheet disposed to be urged by the door against a side of one of the coils which extends longitudinally along the sloped configuration at a location which is nearest to the end of the header to catch condensate dripping off the evaporator tube and to drain the condensate away from the coils.

14. The heat exchanger assembly according to claim 13, wherein the coils are disposable in an air stream and the fluid comprises refrigerant.

15. The heat exchanger assembly according to claim 13, wherein:

the heat exchanger further comprises a drain pan disposed at the bottom ends of the coils opposite the header at the bottom of the sloped configuration, the tube sheet extends along the side of the one of the coils extending longitudinally along the sloped configuration from the header to the drain pan, and the evaporator tube is fluidly communicative with an input end of the header to deliver the fluid to the header.

16. The heat exchanger assembly according to claim 13, wherein:

the sloped configuration includes first and second sloped configurations forming a V-shaped configuration, the coils are provided in the V-shaped configuration with the header provided as a first header at the top ends of a first portion of the coils at the top of the first sloped configuration and a second header at the top ends of a second portion of the coils at the top of the second sloped configuration, the heat exchanger further comprises a drain pan disposed at respective bottom ends of the first and second portions of the coils opposite the first and second headers, respectively, at the respective bottoms of the first and second sloped configurations, the tube sheet is provided as a first tube sheet that extends along the side of the one of the coils of the first portion of the coils extending longitudinally along the first sloped configuration from the first header to the drain pan and as a second tube sheet that extends along the side of the one of the coils of the second portion of the coils extending longitudinally along the second sloped configuration from the second header to the drain pan, and the evaporator tube is fluidly communicative with an input end of the first header to deliver the fluid to the first header and with an output end of the second header to receive the fluid from the second header.

17. The heat exchanger assembly according to claim 13, further comprising a drain pan disposed at the bottom ends of the coils opposite the header at the bottom of the sloped configuration.

18. The heat exchanger assembly according to claim 13, wherein the tube sheet has one of a C-shaped cross-section, an L-shaped cross-section and a curved cross-section.

19. The heat exchanger assembly according to claim 13, wherein the tube sheet is attached to the side of the one of the coils extending longitudinally along the sloped configuration by one or more of a weld, one or more fasteners and adhesive.

20. The heat exchanger assembly according to claim 13, further comprising foam interposed between the tube sheet and the side of the one of the coils extending longitudinally along the sloped configuration, the foam extending from the header at the top ends of the coils and toward the bottom of the sloped configuration.

* * * * *